US006378278B1

(12) United States Patent
Talbot

(10) Patent No.: US 6,378,278 B1
(45) Date of Patent: Apr. 30, 2002

(54) SADDLE ASSEMBLY FOR HANDICAPPED PEOPLE

(76) Inventor: Isabelle Talbot, 433 - 5e Rang, St-Bernard de Michaudville, QC (CA), J0H 1C0

( * ) Notice: Subject to any disclaimer, the term of this patent is extended or adjusted under 35 U.S.C. 154(b) by 0 days.

(21) Appl. No.: 09/640,930

(22) Filed: Aug. 17, 2000

(30) Foreign Application Priority Data

Aug. 17, 1999 (CA) ..... 2280347

(51) Int. Cl.[7] ..... B68C 1/04; B68B 1/00
(52) U.S. Cl. ..... 54/44.3; 54/46.1
(58) Field of Search ..... 54/36, 44.1, 44.3, 54/46.1, 71

(56) References Cited

U.S. PATENT DOCUMENTS

| | | | | | |
|---|---|---|---|---|---|
| 2,037,275 | A | * | 4/1936 | Senderman | 54/44.3 |
| 5,029,434 | A | * | 7/1991 | Erickson | 54/44.1 |
| 5,094,062 | A | * | 3/1992 | Clark | 54/16 X |
| 5,383,327 | A | * | 1/1995 | Dohln | 54/44.1 |

* cited by examiner

*Primary Examiner*—Robert P. Swiatek
(74) *Attorney, Agent, or Firm*—Eric Fincham

(57) ABSTRACT

A saddle assembly for use by handicapped riders, a saddle assembly including a bridle having reins extending therefrom and a saddle having stirrups connected thereto, the improvement comprising interconnecting straps extending between the stirrups and the reins whereby movement of the reins would cause movement of one or more of the stirrups.

9 Claims, 4 Drawing Sheets

SADDLE ASSEMBLY FOR HANDICAPPED PEOPLE

The present invention relates to a saddle assembly and more particularly, relates to a saddle assembly suitable for use with handicapped people.

BACKGROUND OF THE INVENTION

Horseback riding is a widely practised activity enjoyed by many. However, for physically handicapped people and particularly those without full use of their legs, it becomes extremely difficult to practice the sport. For example, the rider without use of the legs cannot provide the proper signals to the horse in a conventional manner.

SUMMARY OF THE INVENTION

It is an object of the present invention to provide a saddle assembly suitable for use by handicapped people.

According to one aspect of the present invention, in a saddle assembly which includes a bridle having reins extending therefrom and a saddle having stirrups connected thereto, there is provided the improvement comprising of interconnecting means extending between said stirrups and said reins whereby movement of said reins will cause movement of one or more of said stirrups.

In greater detail, the present invention will preferably include a number of conventional components of a saddle assembly including the seat portion. Preferably attached to the seat portion is an upwardly extending back adapted to support the rider.

The back may include means for retaining the person in a desired position, and to this end, would include straps or the like.

The back member may also be attached in a manner such that it is moveable with respect to the seat. Thus, it is possible that the back would be rotatable and/or could be moveable to a substantially horizontal position. Furthermore, the back member may be releasably attached to the saddle for those riders not requiring the support. A headrest portion may also be provided and suitable cushioning and support means will be associated therewith. Preferably, the headrest is adjustable in a vertical direction along with means for retaining the same in a desired position. Such means are well known in the art and need not be discussed in detail herein.

The general assembly will preferably include such conventional components such as a saddle horn, a pad underneath the seat portion along with fenders and stirrups.

The assembly is used with a conventional bridle which may include a head stall, browband, cheek straps and noseband. The interconnecting means will preferably comprise a member extending between the reins and the stirrups such that movement of the reins will cause a corresponding movement in the stirrup. This will replicate the action of a conventional rider and allow the horse to properly respond to the commands.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
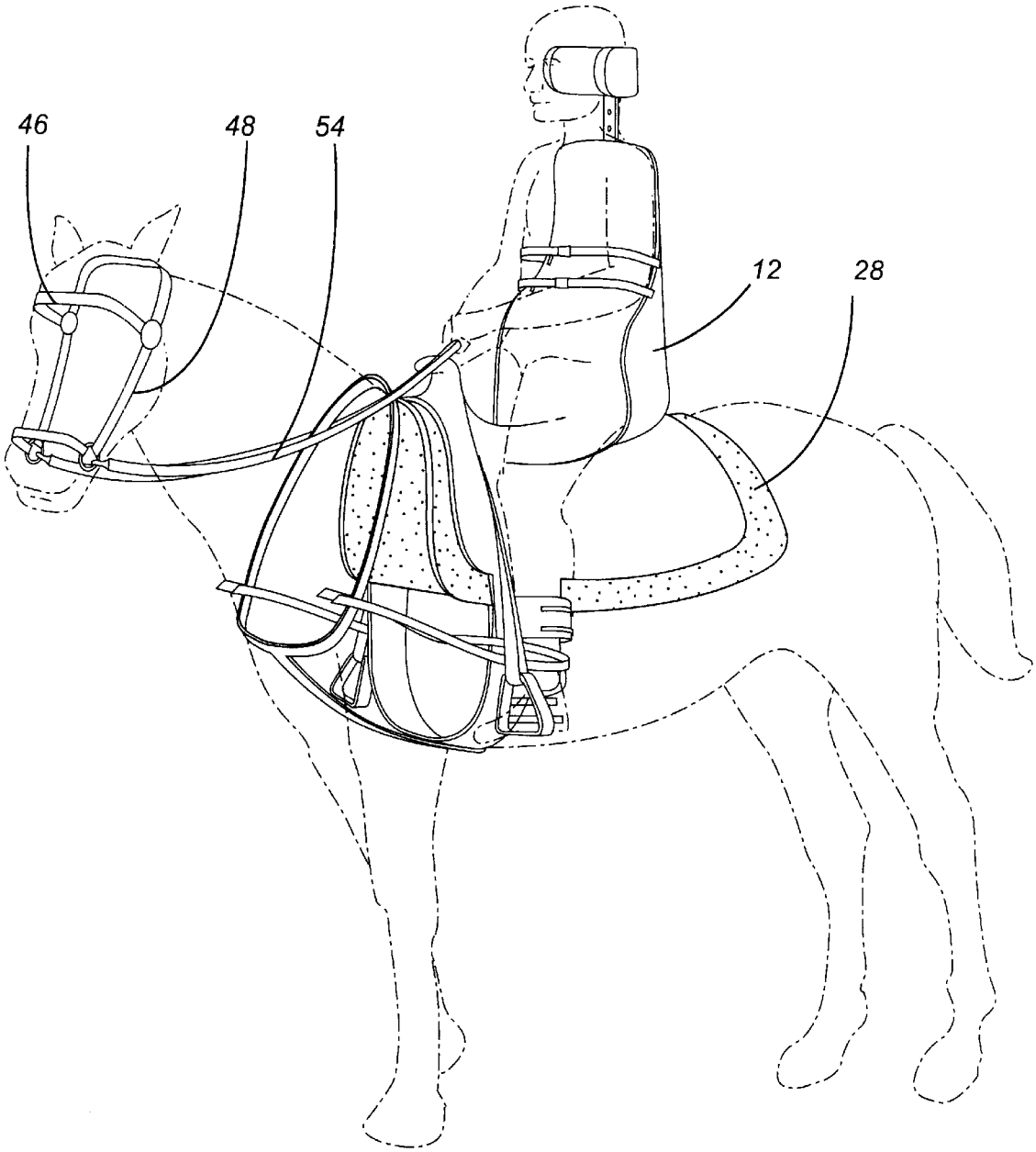
FIG. 1 is a perspective view illustrating use of the saddle assembly of the present invention.
Figure 3:
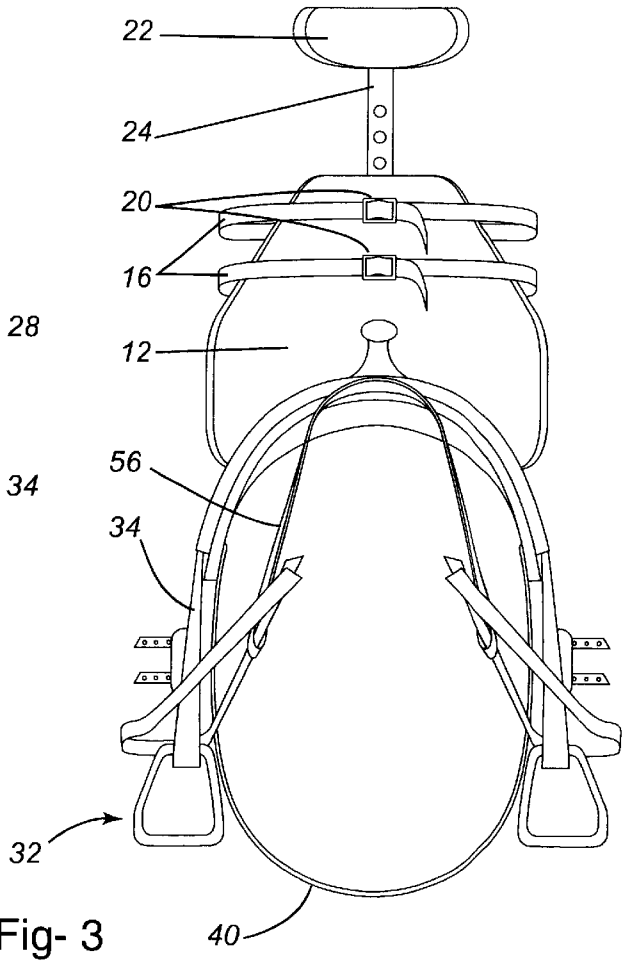
FIG. 3 is a front view of the saddle assembly.
Figure 2:
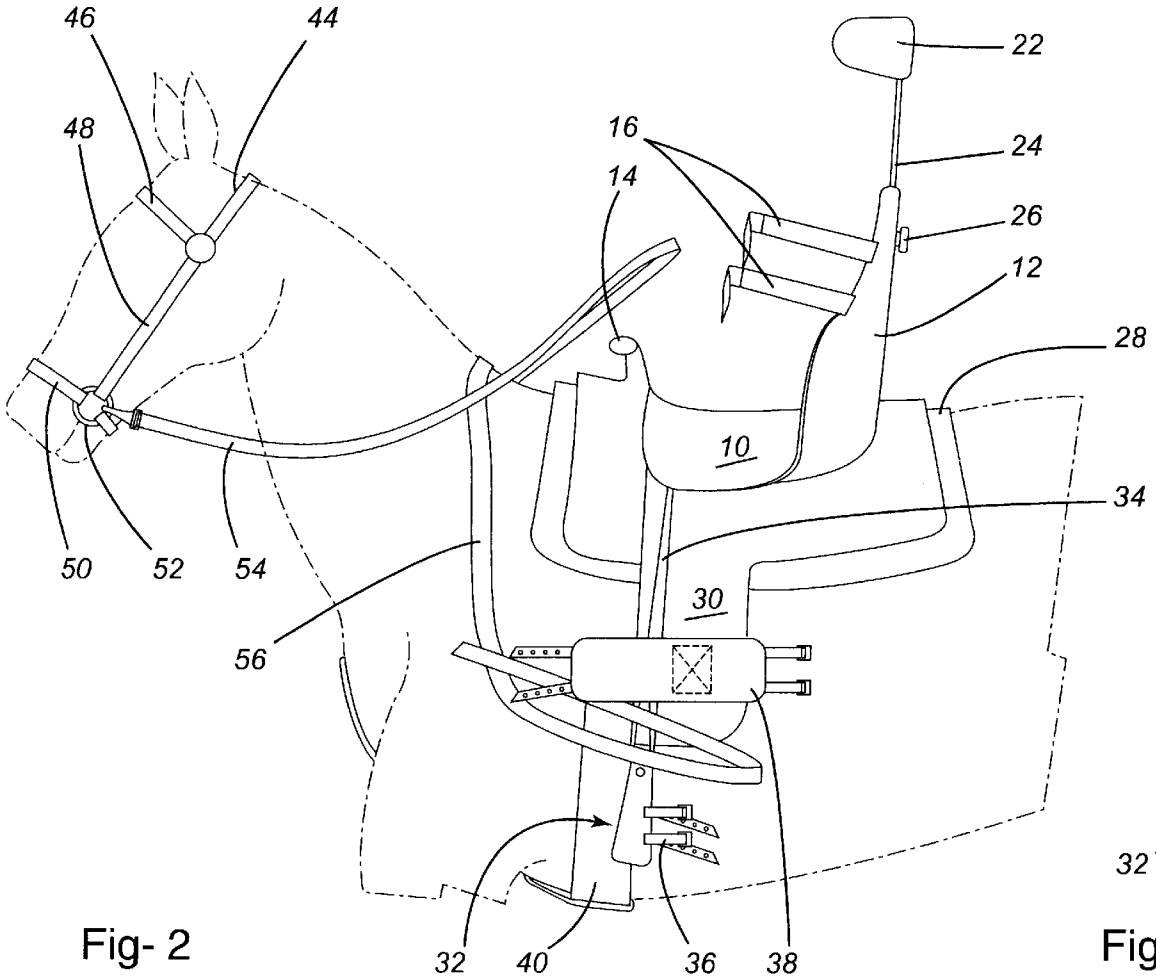
FIG. 2 is a partial side view of the saddle assembly of the invention.

Referring to the drawings in greater detail and by reference characters thereto, the saddle assembly includes a conventional seat portion which is designated by reference numeral 10. Attached to the seat is a back member 12. The saddle includes a conventional saddle horn 14. A pair of straps 16 are associated with back 12 and include buckles 20 for purposes of retaining the rider.

Back member 12 includes a head rest portion generally designated by reference numeral 22 and which head rest portion is mounted on a shaft 24 which is retained in a desired position by means of a screw 26.

The saddle has a pad 28 underneath and also has fenders 30 extending downwardly therefrom. Stirrups 32 are attached by means of stirrup straps 34. Stirrups 32 also include stirrup tie straps 36 for retaining the foot of the rider. Similarly, leg tie straps 38 may be suitably secured to fenders 30 for secure engagement with the leg of the rider.

As is conventional, the saddle includes a girth strap 40.

Bridle 42 includes a head stall 44 and a browband 46. Cheek straps 48 extend to a noseband 50. Snaffle bits 52 are provided and which are attached to reins 54.

According to the present invention, there is provided an interconnecting strap 56 which, in each side, will extend from stirrup 32 to be secured to the reins 54. Thus, movement of the reins will also cause movement of the stirrups to provide the proper signals to the horse.

Figure 4A:
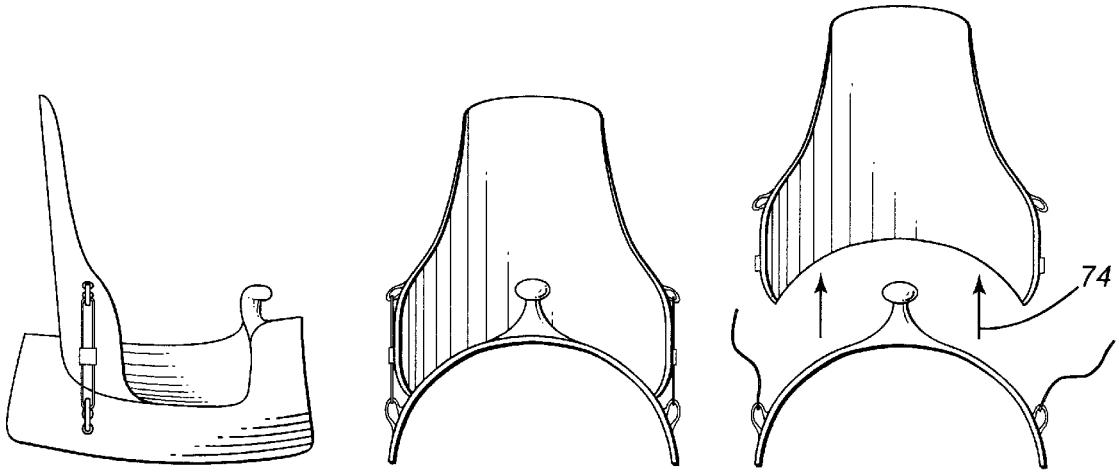
FIGS. 4A, 4B and 4C are views of different seat arrangements.
Figure 4B:
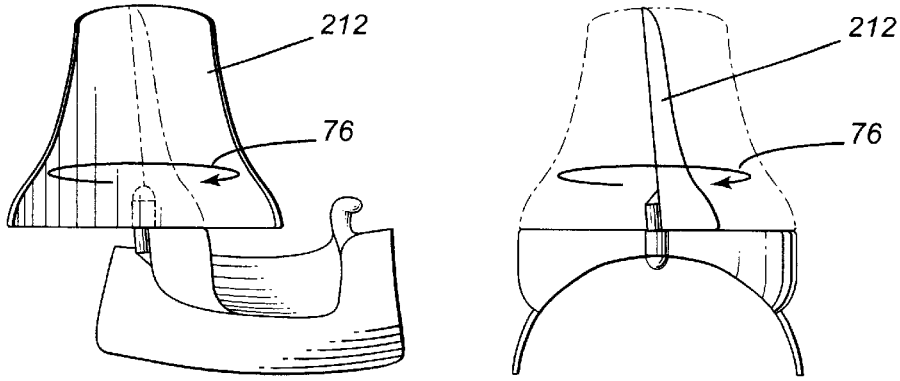
Figure 4C:
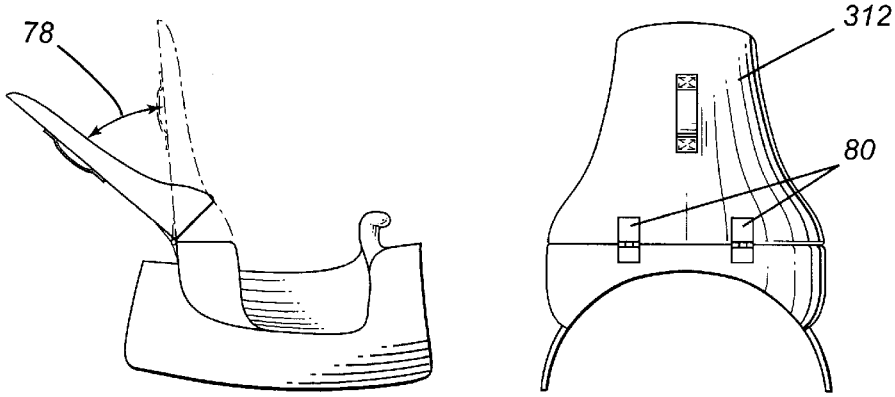

Turning to FIGS. 4A, 4B and 4C, there is illustrated a modified back portion 112 which is adjustable in height as indicated by arrows 74. A further version is illustrated in FIG. 4B wherein back portion 212 has a pivoting structure and can turn as indicated by arrows 76. In FIG. 4C, a further embodiment of a back portion 312 can be rotated backwardly as indicated by arrow 78 by means of hinge members 80.

Figure 5A:
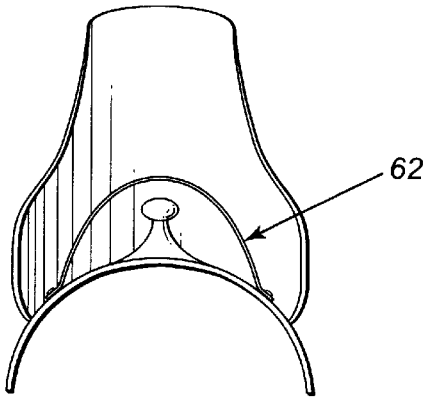
FIGS. 5A, 5B and 5C show different handles which may be incorporated with the saddle.
Figure 5C:
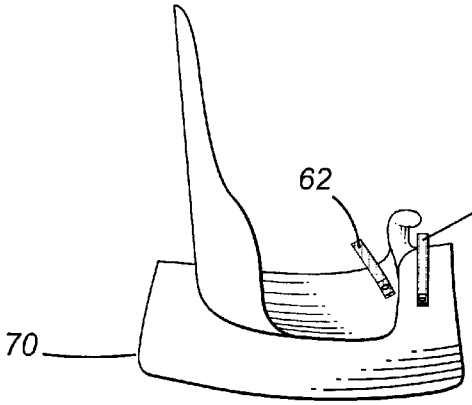
Figure 5B:
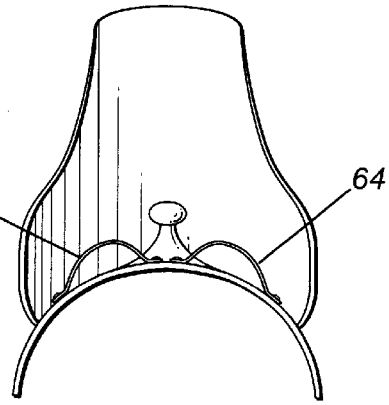

As shown in FIGS. 5A, 5B and 5C, there may be provided a plurality of different handles depending upon the needs of the rider. Thus, as shown in FIG. 5A, there is provided a single handle 62 at the front of the saddle 10. In FIG. 5B, there is provided a pair of handles 64 and 66 at the front of the saddle. FIG. 5C illustrates a combination of the above wherein there is provided both a single handle 62 and a double handle 64, 66 arrangement.

Also, as may be seen in FIG. 5C, the saddle may be provided with an inflatable cushion generally designated by reference numeral 70. Inflatable cushion 70 can assist in the balancing and provides a flexible seat arrangement. Suitable pump means may be provided for adjusting the pressure within cushion 70.

Figure 6:
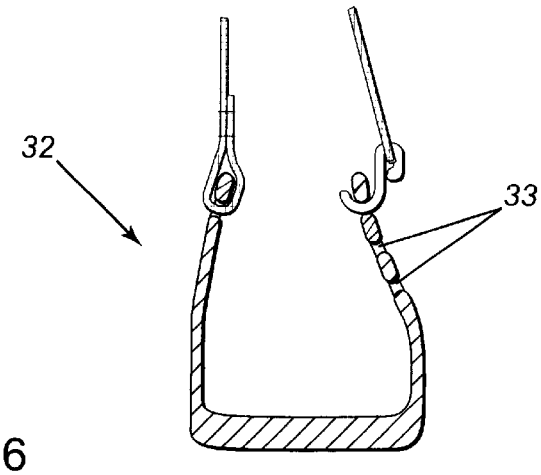
FIG. 6 is a detailed view of an alternative arrangement for the stirrup straps.

As shown in FIG. 6, stirrup 32 is preferably made to be adjustable and thus, there may be different attachment means 33. Stirrup 32 is also preferably turnable from one side to the other and is provided with one side which is larger than the other to provide for the stirrup adjustability. A suitable anti-slip surface may be provided thereon.

It will be understood that the above described embodiment is for purposes of illustration only and that changes and modifications may be made thereto without departing from the spirit and scope of the invention.

I claim:

1. In a saddle assembly which includes a bridle having left and right reins extending therefrom and a saddle having left and right stirrups connected thereto, the improvement comprising left and right interconnecting straps, said left interconnecting strap extending between said left rein and said left stirrup and said right interconnecting strap extending between said right rein and said right stirrup, whereby movement of one of said reins will cause movement of a corresponding one of said stirrups.

2. The improvement of claim 1 wherein said saddle includes a seat portion, a back rest connected to said seat portion.

3. The improvement of claim 2 further including a head rest assembly, said head rest assembly being adjustably connected to said back rest.

4. The improvement of claim 2 wherein said back portion is adjustable with respect to said seat portion.

5. The improvement of claim 1 further including handle means, said handle means being located at a front portion of said saddle.

6. The improvement of claim 5 wherein there are provided a plurality of individual handle means.

7. In a saddle assembly which includes a bridle having left and right reins and a saddle having left and right stirrups connected thereto, the improvement wherein said saddle includes a seat portion, a back rest connected to said seat portion, a head rest assembly, said head rest assembly being adjustably connected to said back rest.

8. The improvement of claim 7 wherein said back portion is adjustable with respect to said seat portion.

9. The improvement of claim 8 further including a plurality of individual handle means located at a front portion of said saddle.

* * * * *